United States Patent [19]

Kutin

[11] 4,112,313

[45] Sep. 5, 1978

[54] TIMER CONTROL ARRANGEMENT FOR USE WITH A WALL SWITCH

[76] Inventor: Lawrence H. Kutin, 2 Warren Pl., Plainview, N.Y. 11803

[21] Appl. No.: 804,861

[22] Filed: Jun. 8, 1977

[51] Int. Cl.[2] ..... H01H 43/00

[52] U.S. Cl. ..... 307/141; 315/360; 340/309.4

[58] Field of Search ..... 307/141, 141.4, 141.8, 307/139, 157; 315/360; 200/38 FB; 340/309.4

[56] References Cited

U.S. PATENT DOCUMENTS 3,491,249 1/1970 Rabinow ..... 307/141

3,889,132 6/1975 Vreeland ..... 307/141

*Primary Examiner*—Robert K. Schaefer
*Assistant Examiner*—Morris Ginsburg
*Attorney, Agent, or Firm*—Kenyon & Kenyon, Reilly, Carr & Chapin

[57] ABSTRACT

A timer control arrangement for use with a wall switch comprising a basic timer assembly of a type typically employed for use with wall sockets, a transformer having primary and secondary windings, and a switch means for selectively connecting the terminals of the primary and secondary windings to the terminals of the timer assembly.

8 Claims, 2 Drawing Figures

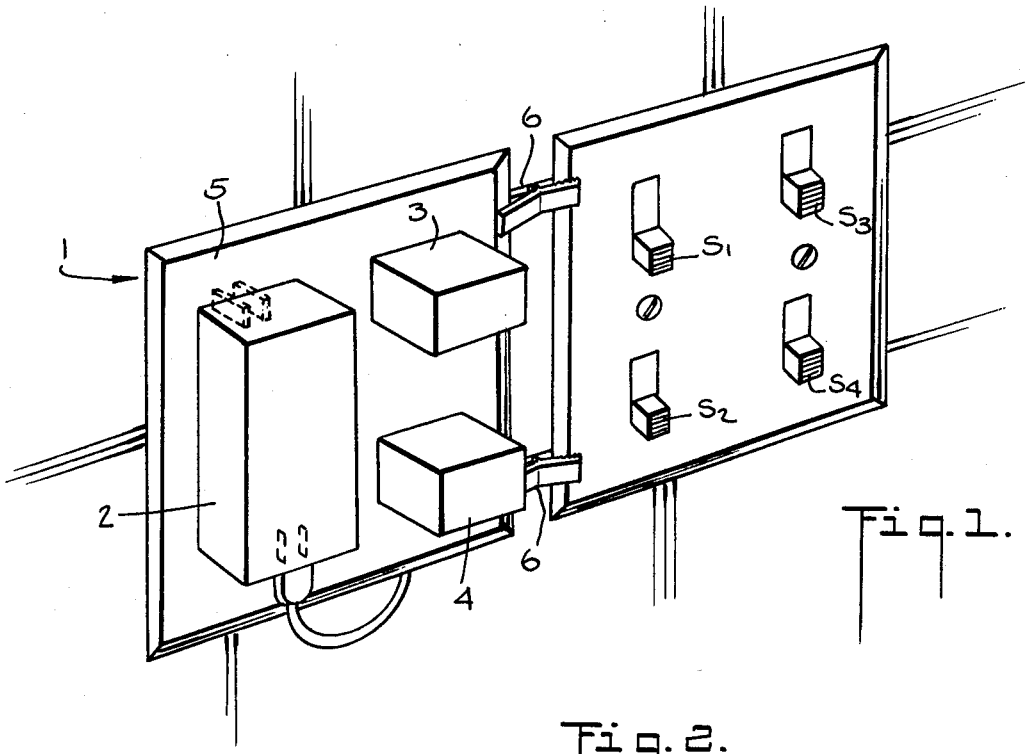
Fig. 1.
Fig. 2.
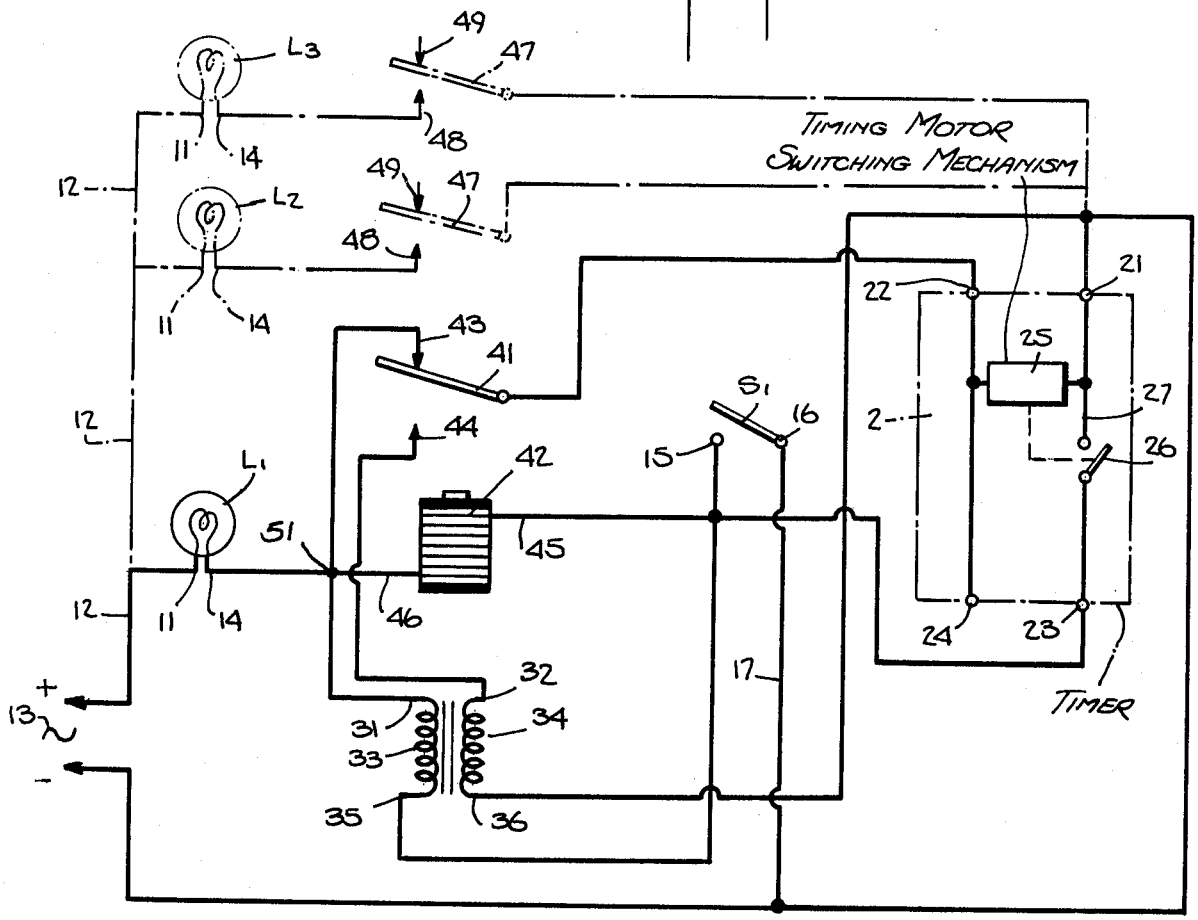

TIMER CONTROL ARRANGEMENT FOR USE WITH A WALL SWITCH

BACKGROUND OF THE INVENTION

1. Field of the Invention

This invention relates to timer control arrangements and in particular to timer control arrangements which are adapted for use with a wall switch for controlling the lights associated therewith.

2. Description of the Prior Art

Timer control arrangements for controlling the on-off conditions of lights connected to a wall outlet fed by an ac supply voltage are well known in the art. Typically, such arrangements include a basic timer assembly having first and second input terminals which are adapted to be connected to the terminals of the wall outlet. These input terminals feed a timing motor switching mechanism which controls a switch for closing and opening a current path connected between the first input terminal of the assembly and a first output terminal thereof. A second output terminal of the assembly is connected to its second input terminal.

During the period when the timing motor switching mechanism closes the current path between the first input terminal and the first output terminal of the assembly, the ac supply voltage across the terminals of the wall outlet is connected across both the electrical appliance, i.e., the light, being controlled by the arrangement and the timing motor mechanism included in the arrangement. Supply current, thus, flows through the light causing the light to turn on, as well as through the timing motor mechanism causing the latter to run. During all other periods, when the motor mechanism opens the current path between first input and first output terminals of the assembly, the supply voltage across the wall outlet is no longer connected across the light, so the light remains off. The supply voltage, however, remains across the input terminals of the timer assembly, to thereby continue operation of the motor mechanism.

While the timer control arrangements which include the aforesaid basic timer assembly are readily adaptable for use with external lights connected to a wall outlet, they cannot be used for controlling lights operated by a wall switch. In particular, since at a wall switch in a home only one terminal of the ac supply voltage is available for connection to external equipment, the aforesaid timer control arrangements cannot simply be placed in the circuit of the switch. Various other timer control arrangements including modified forms of the basic timer assembly have thus been devised.

U.S. Pat. No. 3,491,249 discloses one such timer control arrangement wherein the timing motor switching mechanism is provided with two series windings, one of high impedance and the other of low impedance. The arrangement is further provided with a switching contact arrangement which is controlled by the motor mechanism to connect the high impedance winding in series with the light being controlled when the light is being turned off by the arrangement, and to connect the low impedance winding in series with such light, when the light is being turned on by the arrangement. In this manner, sufficient current is always delivered to the motor mechanism to maintain its operation, while the operation of the arrangement to turn the light being controlled on and off is not disturbed.

To permit manual operation of the light being controlled by the aforesaid modified time control arrangement, the arrangement is further provided with a switch for bypassing the motor mechanism. Operation of the aforesaid switch, thus, discontinues operation of the motor mechanism and the timed control of the light provided thereby is halted. Hence, while this type of modified timer control arrangement can provide timed or manual control of a light, it cannot provide both types of control simultaneously.

U.S. Pat. No. 3,889,132 discloses another type of timer control arrangement wherein the arrangement includes the above-described basic timer assembly and is used to control a light associated with a wall switch which is situated above two associated wall sockets. In this arrangement, the input terminals and output terminals of the timer control assembly are connected to the respective wall sockets and the wiring connections between the sockets are modified so as to enable the switch to be bypassed when it is desired that the timer arrangement control the light. Thus, again while this arrangement permits either timed or manual control of a light, it does not permit both types of control to be exercised simultaneously.

It is, therefore, an object of the present invention to provide a timer control arrangement which includes the above-described basic timer assembly and which is further adapted for use with a wall switch in such a manner that the wall switch and the timer arrangement can both function simultaneously to control the lights associated with the switch.

SUMMARY OF THE INVENTION

In accordance with the principles of the present invention the above and other objectives are accomplished in a timer control arrangement comprising the above-described basic timer assembly, a transformer having primary and secondary windings, and a switch means for selectively connecting the terminals of the primary and secondary windings to the terminals of the timer assembly.

More specifically, the primary and secondary windings of the arrangement have first terminals which are connected to the respective first output and first input terminals of the timer assembly. The second terminals of the aforesaid windings, in turn, are adapted to be selectively connected to the second input terminal of the timer assembly, via the switch means.

For connection into the circuit of the wall switch, the first and second terminals of the primary winding are further adapted to be connected, respectively, to the line leading from light to be controlled and to a first contact terminal of the wall switch associated with such light. Additionally, the first output terminal and the first input terminal of the timer assembly are adapted to be connected, respectively, to the aforesaid first terminal of the wall switch and to a second contact terminal of the wall switch, the latter second contact terminal being the switch terminal connected to the line leading to the ac supply.

As above indicated, the switch means of the arrangement functions to selectively connect the second terminal of the primary winding and the second terminal of the secondary winding to the second input terminal of the timer assembly. In particular, during the open condition of the wall switch and of the current path between the first input and first output terminal of the timer assembly, the switch means causes the second terminal of the primary winding to be connected to the second terminal of the timer and, simultaneously, causes the second terminal of the secondary winding to be disconnected from such second terminal of the timer. When either the wall switch or the aforesaid current path are closed, the switch means functions to connect the second terminal of the secondary winding to the second input terminal of the timer and disconnects the second terminal of the primary winding from such terminal.

As will be discussed more fully below, with the timer control arrangement configured as above-described and the switch means thereof functioning as aforesaid, sufficient voltage and current is always present at the first and second input terminals of the timer assembly for driving the motor mechanism connected thereacross irrespective of the condition of the wall switch and of the current path of the assembly. Hence, the motor mechanism will continue to operate even when the wall switch is used to operate the light, therby permitting simultaneous timed and manual control thereof.

In the embodiment of the invention to be disclosed hereinafter, the switch means of the timer control arrangement is in the form of a relay contact switch having a relay coil and at least two fixed poles and one movable contact. The two fixed poles are connected to the respective second terminals of the primary and secondary windings, while the movable contact is connected to the second terminal of the timer assembly. The relay coil, in turn, is connected with one terminal to the second terminal of the primary winding and with its other terminal to the first output terminal of the timer assembly.

In a futher aspect of the invention, the components of the timer control arrangement are mounted on a single mounting plate. The mounting plate, in turn, is connected via connecting means to the decorative wall plate surrounding the switch being controlled. This permits the timer control arrangement to be arranged immediately adjacent the wall switch, thereby permitting easy access and electrical connection thereto.

DESCRIPTION OF THE DRAWINGS

The above and other features and aspects of the present invention will become more apparent upon reading the following detailed description in conjunction with the accompanying drawings in which:

FIG. 1 illustrates the physical configuration of a timer control arrangement in accordance with the principles of the present invention; and FIG. 2 shows the electrical configuration of the timer control arrangement of FIG. 1.

DETAILED DESCRIPTION

FIG. 1 illustrates a timer control arrangement 1 in accordance with the principles of the present invention. As shown, the timer control arrangement 1 comprises a basic timer assembly 2, a transformer 3 and a contact relay 4. The aforesaid components are all mounted on a single mounting plate 5 having clips 6 arranged on its side. The clips 6 clamp onto a standard wall plate, through which extend conventional wall switches $S_1$, $S_2$, $S_3$, and $S_4$ which control lights associated therewith as, for example, overhead lights in a home.

FIG. 2 illustrates the electrical connections between the components of the timer control arrangement 1 and the switch $S_1$ and its associated lights or lamps $L_1$ to $L_3$. Preferably, the light $L_1$ might be an incandescent lamp, while the lights $L_2$ and $L_3$ might be either incandescent or fluorescent lamps. Each of the lights $L_1$ to $L_3$ has first and second terminals 11 and 14. The first terminals 11 of the lights are connected via lines 12 to the first terminal (shown as positive) of an ac voltage supply or source 13. The second terminal (shown as negative) of the ac source 13, in turn, is coupled to a movable contact 16 of the switch $S_1$. As will be discussed more fully hereinbelow, closing of the switch $S_1$ by bringing the movable contact 16 into contact with a further contact 15 of the switch causes the lights $L_1$ to $L_3$ to turn on, while not disturbing the operation of the timer control arrangement 1. As a result, manual control of the lights via the switch $S_1$ and timed control of the lights via timer arrangement 1 can be simultaneously achieved.

As above-indicated, the timer control arrangement 1 includes the basic timer assembly 2 which, typically, might be a timer assembly model D-111B manufactured by Intermatic. As shown, it includes first and second input terminals 21 and 22 and first and second output terminals 23 and 24. Connected between the input terminals 21 and 22 is a timing motor switching mechanism 25. The switching mechanism 25 exercises timed control over a switch 26 inserted in the current path 27 between the first input terminal 21 and first output terminal 23. Opening and closing of the switch 26, thus, likewise causes opening and closing of the current path 27.

The first input terminal 21 and first output terminal 23 of the assembly 2 are further connected to the respective terminals 16 and 15 of the switch $S_1$. The second input terminal 22 of the assembly, in turn, is connected to a movable contact 41 of the contact relay 4, the latter movable contact being controlled by a relay coil or solenoid 42 for movement between two fixed poles 43 and 44 of the relay.

The poles 43 and 44 provide connection of the movable contact 41 and, thus, the second input terminal 22 of the assembly 2 to respective first terminals 31 and 32 of the primary and secondary windings 33 and 34 of the transformer 3. The respective second terminals 35 and 36 of the primary and secondary windings 33 and 34 are, in turn, connected to the first output 23 and the first input terminal 21 of the timer assembly 2. A first terminal 45 of the relay coil 42 is also connected to the first output terminal 23 of the assembly 2. The second terminal 46 of the coil 42 is, in turn, connected to a common point 51 to which is also connected the pole 43, the terminal 31 of the winding 33 and the light terminal 14.

The contact relay 4 is further provided with two other sets of contacts and poles associated with the lights $L_2$ and $L_3$. Each set includes a movable contact 47 connected to the first input terminal 21 of the timer assembly, a first fixed pole 48 connected to the terminal 14 of its respective light and a second fixed pole 49 which has been left open.

FIG. 2 shows the condition of the timer control arrangement for the situation where both the switch $S_1$ and the current path 27 between the first input terminal 21 and first output terminal 23 of the assembly 2 are open. In this condition of the arrangement, current flows from the positive terminal of the ac supply source 13 through the light $L_1$, the pole 43, the contact 41, the second input terminal 22, the motor mechanism 25, the first input terminal 21, and back to the negative terminal of the ac source. The combined impedance of the motor mechanism 25 and light $L_1$ is such that this current is insufficient to turn on the light $L_1$, and, hence, the light $L_1$ remains "off." On the other hand, such current is sufficient to operate the motor mechanism 25, and thus, the motor mechanism is caused to run.

If switch $S_1$ remains open, the motor mechanism 25 will continue to run in a conventional manner to provide timed closing and opening of the switch 26 and, hence, timed closing and opening of the current path 27 between the first input terminal 21 and the first output terminal 23 of the timer assembly 2. During the time that the motor mechanism closes the switch 26 and, therefore, the current path 27, current flows from the positive terminal of the ac source through the coil 42, the first output terminal 23, the current path 27, the first input terminal 21, and back to the negative terminal of the source. Since the combined impedance of the relay coil 42 and current path 27 is relatively low, the current through the light $L_1$ is now sufficient to turn the light $L_1$ on. As a result, the light $L_1$ now turns on.

Also, at this time, the current through the coil 42 causes the coil to be energized, while a small voltage simultaneously appears across the primary winding 33 of the transformer 3. The energized coil, in turn, moves the contacts 47 to the poles 48, thereby also turning on the lights $L_2$ and $L_3$. The contact 41 is also moved by the energized coil from the pole 43 to the pole 44. The terminals of the secondary 34 of the transformer are thereby connected across the input terminals 21 and 22 of the timer assembly. The stepped up voltage across the transformer secondary is, thus, now across the motor mechanism 25 causing the mechanism to continue to run, while the lights $L_1$ to $L_3$ are on.

The lights $L_1$ to $L_3$ will remain on until the motor mechanism 25 again opens the switch 26 and, hence, the current path 27. When this occurs, the current through the coil 42 ceased to flow, deenergizing the coil 42 and turning off the light $L_1$. Simultaneously, therewith the voltage across the primary winding 33 and, hence, the secondary winding 34 drops to zero. The deenergizing of the coil 42, in turn, moves the contacts 47 back to the poles 49 and the contact 41 back to the pole 43. The arrangement, thus, returns to its prior condition and the lights $L_1$ to $L_3$ remain off, while a current sufficient to continue the running of the motor mechanism flows via the current path from the positive terminal of the ac source through the light $L_1$, the pole 43, the contact 41, the input terminal 22, motor mechanism 25, the input terminal 21, and back to the negative terminal.

As indicated above, the timer control arrangement will also continue to operate as above-described, even when the switch $S_1$ is used to operate the light $L_1$. Thus, when the switch $S_1$ is closed, a current path is established from the positive terminal of the ac source through the light $L_1$, the relay coil 42, the switch $S_1$ and back to the negative terminal of the source. Since the relay coil and the switch $S_1$ are of a relatively low impedance, the current through the light $L_1$ is again increased and the light $L_1$ turns on. Similarly, as with the closing of the switch 26, energization of the relay coil 42 causes movement of the contacts 47 to the poles 48 and the movement of the contact 41 to the pole 44. The lights $L_2$ and $L_3$ are thus turned on and a stepped up voltage appears across the terminals of the winding 34 and, hence, across the input terminals 21 and 22 of the timer assembly. The motor mechanism 25 is, therefore, again continuously energized by the voltage across the secondary winding, while the lights $L_1$ to $L_3$ remain on and the switch $S_1$ is closed. Opening of the switch $S_1$ returns the circuit to its original condition, with the lights $L_1$ to $L_3$ turned off and the motor mechanism 25 driven by the current flowing from the positive terminal of the ac source through the light $L_1$, the pole 43, the contact 41, the input terminal 22, the motor mechanism 25, the input terminal 21 and back to the negative terminal of the source.

It should be noted that similarly to the light $L_1$, the lights $L_2$ and $L_3$ can be operated via their respective switches $S_2$ and $S_3$ without disturbing the operation of the timer control arrangement. While not shown in FIG. 2, the switches $S_2$ and $S_3$ would normally be connected between the pole 48 and movable contact 47 associated with their respective lights.

It should be further noted that satisfactory operation of the timer arrangement 1 of FIG. 1 is found to result when the impedance of the primary winding 33 and the relay coil 42 is such that the voltage drop thereacross does not exceed 6.5 volts ac. Similarly, the transformer secondary winding 34 should preferably be designed to step up the voltage at the primary winding to 115 volts ac. Finally, to ensure that the primary winding 33 and the relay coil 42 are simultaneously activated when the switch $S_1$ or the switch 26 is closed, it is preferred that the winding and coil have equal impedances.

In all cases, it is understood that the above-described arrangement is merely illustrative of the many possible specific embodiments which represent applications of the present invention. Numerous and varied other arrangements can readily be devised in accordance with the principles of the present invention without departing from the spirit and scope of the invention.

What is claimed is:

1. A timer control arrangement for use with a wall switch, said wall switch having first and second contacts, said first contact being connected to one terminal of an ac voltage source and said wall switch being adapted to connect a first terminal of a light source to said one terminal of said voltage source, the light source having a second terminal connected to the other terminal of said voltage source, said arrangement comprising:

a timer assembly adapted to connect for a predetermined period of time said first terminal of said light source to said one terminal of said voltage source, said timer assembly including: first, second and third terminals, said second and third terminals being adapted to be connected to the respective first and second contacts of said wall switch; a current path connected between said second and third terminals, said current path including a switch for opening and closing said current path; and a timing motor switching means connected between said first and second terminals for controlling said switch to close said current path during said predetermined period of time;

a transformer having a primary and secondary winding, said primary winding having a first end adapted to be connected to said first terminal of said light source and a second end connected to said third terminal of said timer assembly, said secondary winding having a first end connected to said second terminal of said timer assembly;

and switch means for selectively connecting said first end of said primary winding and a second end of said secondary winding to said first terminal of said terminal of said timer assembly.

2. An arrangement in accordance with claim 1 in which said switch means includes:

first and second fixed poles connected respectively to said first end of said primary winding and to said second end of said secondary winding;

a contact movable between said first and second fixed poles and connected to said first terminal of said timer assembly;

and coil means for actuating said movable contact, said coil means having first and second ends connected to said first and second ends of said primary winding.

3. An arrangement in accordance with claim 2 wherein said wall switch is further adapted to control a plurality of further lights each having a first terminal and a second terminal connected to said other terminal of said voltage source and wherein said switch means further includes for each of said further lights:

a further first fixed pole adapted to be connected to the first terminal of a further light;

a further second fixed pole;

and a further movable contact movable between said further first and second fixed poles and connected to said second terminal of said timer assembly.

4. An arrangement in accordance with claim 2 in which the impedance of said coil means and the impedance of said primary winding are approximately equal.

5. An arrangement in accordance with claim 1 wherein:

said primary winding is configured such that the voltage drop thereacross does not exceed 6.5 volts ac.

6. An arrangement in accordance with claim 5 wherein:

said transformer is a step-up transformer designed to provide an output voltage across said secondary winding of approximately 115 volts.

7. An arrangement in accordance with claim 1 wherein said arrangement further includes:

a mounting plate upon which said timer assembly, transformer and switch means are mounted.

8. An arrangement in accordance with claim 3 wherein said wall switch includes for each of said further lights further first and second contacts and wherein:

the further first fixed pole associated with each of said further lights is adapted to be connected to said further first contact associated with that further light;

and the further movable contact associated with each of said further lights is adapted to be connected to said further second contact associated with that light.

* * * * *